US006346921B1

(12) United States Patent
Excell et al.

(10) Patent No.: US 6,346,921 B1
(45) Date of Patent: Feb. 12, 2002

(54) BROADBAND ANTENNA

(75) Inventors: Peter Stuart Excell, Heaton; Roger William Clarke, Bradford, both of (GB); Adam David Tinniswood, Poughkeepsie, NY (US)

(73) Assignee: University of Bradford (GB)

( * ) Notice: Subject to any disclaimer, the term of this patent is extended or adjusted under 35 U.S.C. 154(b) by 0 days.

(21) Appl. No.: 09/581,859

(22) PCT Filed: Dec. 21, 1998

(86) PCT No.: PCT/GB98/03861

§ 371 Date: Oct. 24, 2000

§ 102(e) Date: Oct. 24, 2000

(87) PCT Pub. No.: WO99/33147

PCT Pub. Date: Jul. 1, 1999

(30) Foreign Application Priority Data

Dec. 20, 1997 (GB) ..... 9726816

(51) Int. Cl.[7] ..... H01Q 11/10

(52) U.S. Cl. ..... 343/792.5; 343/810; 343/812

(58) Field of Search ..... 343/792.5, 810, 343/812, 802, 793

(56) References Cited

U.S. PATENT DOCUMENTS 4,907,011 A * 3/1990 Kuo ..... 343/792.5
5,648,786 A * 7/1997 Chung et al. ..... 343/770

* cited by examiner

*Primary Examiner*—Don Wong
*Assistant Examiner*—James Clinger
(74) *Attorney, Agent, or Firm*—Michael Best & Friedrich LLP

(57) ABSTRACT

A broadband antenna having closely spaced dipole antenna elements to form a log-periodic array, arranged normal to a signal feed network having a separate feed line for each of the dipole elements. The length of each feed line is selected to compensate for phase delays such that all frequency components of the radiated signal are in phase at a predetermined phase reference point of the antenna.

10 Claims, 4 Drawing Sheets

BROADBAND ANTENNA

The present invention relates in general to an antenna for electromagnetic radiation, and in particular, but not exclusively, to an antenna capable of radiating broadband signals without significantly varying the relative phase of the frequency components in the spectrum of the radiated signal.

Most known antennas are inherently 'narrow band'; in other words they only radiate efficiently over a narrow range of radio frequencies. A significant minority are of 'wide-band' design, but are almost invariably intended for reception of a plurality of narrow band signals spread over a wide range of frequencies. For example, the narrow band signals would normally be independent information channels spread over such a range. The relative phase of the frequency components is thus of no importance and the known wide-band antennas tend to impose wide and uncontrolled phase variations on the frequency components.

A widely known example of the prior art is the log-periodic antenna, which comprises a series of elements that resonate at discrete frequencies across the operating band. The feed point to such an antenna is applied at the high frequency end. Waves travel down the feed line until they encounter an element which is approximately resonant and are radiated by that element. A longer clement behind the resonant element acts as a reflector and a shorter element in front as a director, thus causing radiation preferentially in the direction back towards the feed point. It has been found that the result of this mode of operation is that there is a time delay that increases with reducing frequency, imposed by the time taken to travel down the transmission line to the radiating element and then back again in the forward radiating direction. This time delay translates into a frequency-dependent phase variation (dispersion).

A second known design is the horn antenna, which can be of the plain pyramidal type or the wider-band ridged-guide type The typical horn antenna comprises a gently-tapered waveguide which progressively launches waves into space and is inherently of a broadband nature. However, there is still a degree of frequency-dependent phase dispersion in the waveguide portion and horn antennas are also very bulky relative to their operating frequency range.

A third known design is the planar spiral antenna commonly used for radar warning receivers. The planar spiral antenna is inherently circularly polarized and has a linearly-polarised relative, the sinuous antenna. By being flat, these designs inherently have a poorer directivity than the log-periodic or horn types, and in particular they radiate equally backwards as well as forwards. The result is that a layer of absorbent material is required behind the back face which inherently absorb 50% of the radiation. Even in the forward direction the beam shape is very wide. Therefore, radiation in any particular direction is relatively inefficient.

All of the prior art antennas mentioned above suffer to some extent from the same phase dispersion problems as described above with reference to the log-periodic antennas.

An antenna that is known to be inherently broadband and to have very little phase dispersion is the resistively-loaded dipole and several designs for this exist. However such dipoles inherently have a high degree of loss. Further, they produce an omnidirectional radiation pattern.

It is desired to provide an antenna for radiating broadband signals without significantly varying the relative phase of the frequency components in the spectrum of the signal. Preferably, the desired antenna should be compact and inexpensive to manufacture, and show directivity and high efficiency.

According to the present invention there is provided a broadband antenna, comprising: input means for receiving an input signal; a plurality of antenna elements for radiating said input signal; and signal feed means for feeding said input signal from said input means to said plurality of antenna elements; characterised in that: said signal feed means comprises a plurality of independent feed lines each coupled to a respective antenna element of said plurality of antenna elements.

Preferably, each of said plurality of feed lines comprises a delay for delaying the input signal by a predetermined delay amount.

Preferably, said predetermined delay amount is determined by the length of each respective feed line of said plurality of feed lines.

Preferably, said predetermined delay amount compensates for a phase delay between a position of the respective antenna element of said plurality of antenna elements and a predetermined phase reference point.

Preferably, said plurality of antenna elements are arranged to form a log-periodic antenna and said predetermined reference point is at the front of the antenna.

Preferably, said plurality of feed lines are provided by a circuit boards

Preferably, said plurality of antenna elements are arranged generally parallel and co-planar, and said circuit board is arranged normal to said antenna elements Preferably, said signal feed means comprises a feed network provided on said circuit board for splitting, delaying and feeding at least a respective potion of the input signal to each respective antenna element.

Preferably, said feed network comprises a common transmission line coupled to receive said input signal and coupled to each of said plurality of feed lines.

Preferably, said common transmission line is tapered to act as an unbalanced to balanced transformer.

Preferably, said feed lines are arranged to reverse the phase of each alternate antenna element of said plurality of antenna elements.

According to a second aspect of the present invention there is provided a broadband antenna, comprising: a plurality of antenna elements arranged to provide a log-periodic array of dipole elements for radiating an input signal supplied by a signal feed means, characterised in that said signal feed means comprises a plurality of feed lines each coupled to a respective antenna element of said plurality of antenna elements, each feed line being of a predetermined length such that all frequency components of the radiated signal across a predetermined operating range are in phase at a predetermined phase reference point.

Preferably, each feed line comprises a delay for delaying the input signal, or part of the input signal applied to the respective antenna element, by a pre-determined delay amount.

Each element of the antenna preferably radiates optimally at a selected frequency, with relatively long elements radiating at relatively low frequencies, and relatively short elements radiating at relatively high frequencies. Preferably, the length of each respective feed line is selected to compensate for the phase delay between the position of the radiating element and a phase reference point at the front of the antenna. Thus, by selectively delaying each frequency portion of the signal by adjusting the physical length of the delay lines, all frequency components of the radiated signal leave the phase reference point at the front of the antenna in phase.

In a preferred embodiment, the independent feed lines are formed by etching a feed network onto a printed circuit board. Preferably, the printed circuit board is arranged in the plane of a central longitudinal axis of the antenna, and normal to the plane of the individual antenna elements. Since the feed network is normal to the direction of the electric fields radiated by the antenna, distortion is minimised.

The preferred antenna comprises feed lines etched in a feed network on a printed circuit board, with the length of each feed line being, in principle, chosen to compensate for the phase delay between the position of the radiating element and the phase reference point at the front of the antenna. This approach may be contrasted with the use of an electronically pre-distorted input signal intended to compensate for time delays in the antenna by subjecting an input signal with in-phase components to varying amounts of delays for various frequency components of the signal, to compensate for the time delay between a common input point and a respective radiating element.

The antenna described herein is intended particularly for use in radiating high power pulses efficiently, such as for use in the electromagnetic compatibility testing of electronic equipment. The antenna is also intended to be used to receive pulsed signals from interference sources, such as electrostatic discharges, lightning, or simulated nuclear electromagnetic pulses. Further applications include wideband ground probing radar and very wideband communications where the dispersive nature of standard antennas would be unacceptable.

For a better understanding of the invention, and to show how embodiments of the same may be carried into effect, reference will now be made, by way of example, to the accompanying diagrammatic drawings, in which.

Figure 4:
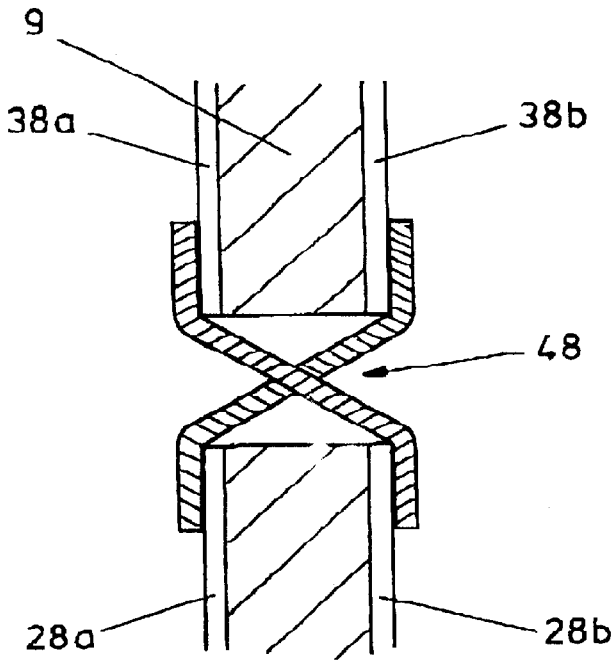
Figure 5:
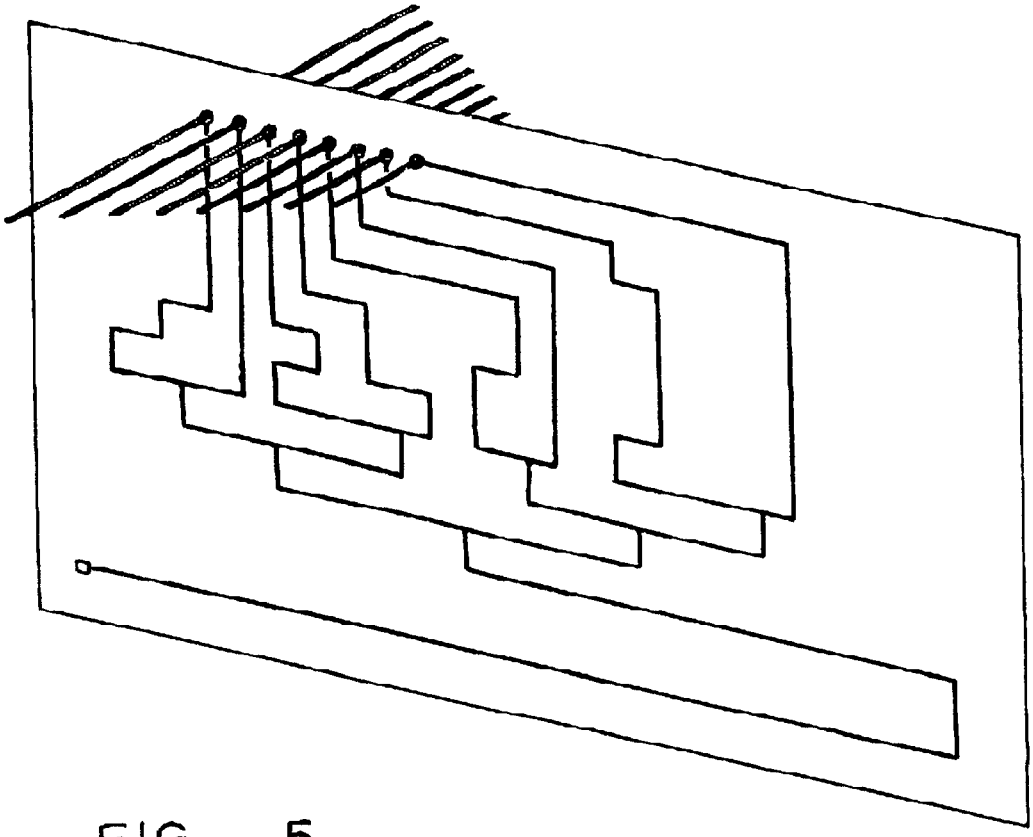

FIG. 4 in an expanded sectional side view of a PCB double via phase reversal arrangement; and FIG. 5 in a perspective view of a preferred antenna.

The antenna of the preferred embodiment relates in particular to the field of electromagnetic compatibility testing, where it is desired to produce an approximation to a plane wave field over a volume sufficient to accommodate the equipment under test. The antenna is designed to be relatively compact, directional and efficient. A further advantage of the preferred antenna is that selected frequencies within the broad frequency range may also be used with a known and stable relative phase, without having to change the antenna. It is further desirable that the signal produced by the antenna be consistent and repeatable between tests on a particular site, and between test sites, and this is achieved by the preferred antenna.

Figure 1:
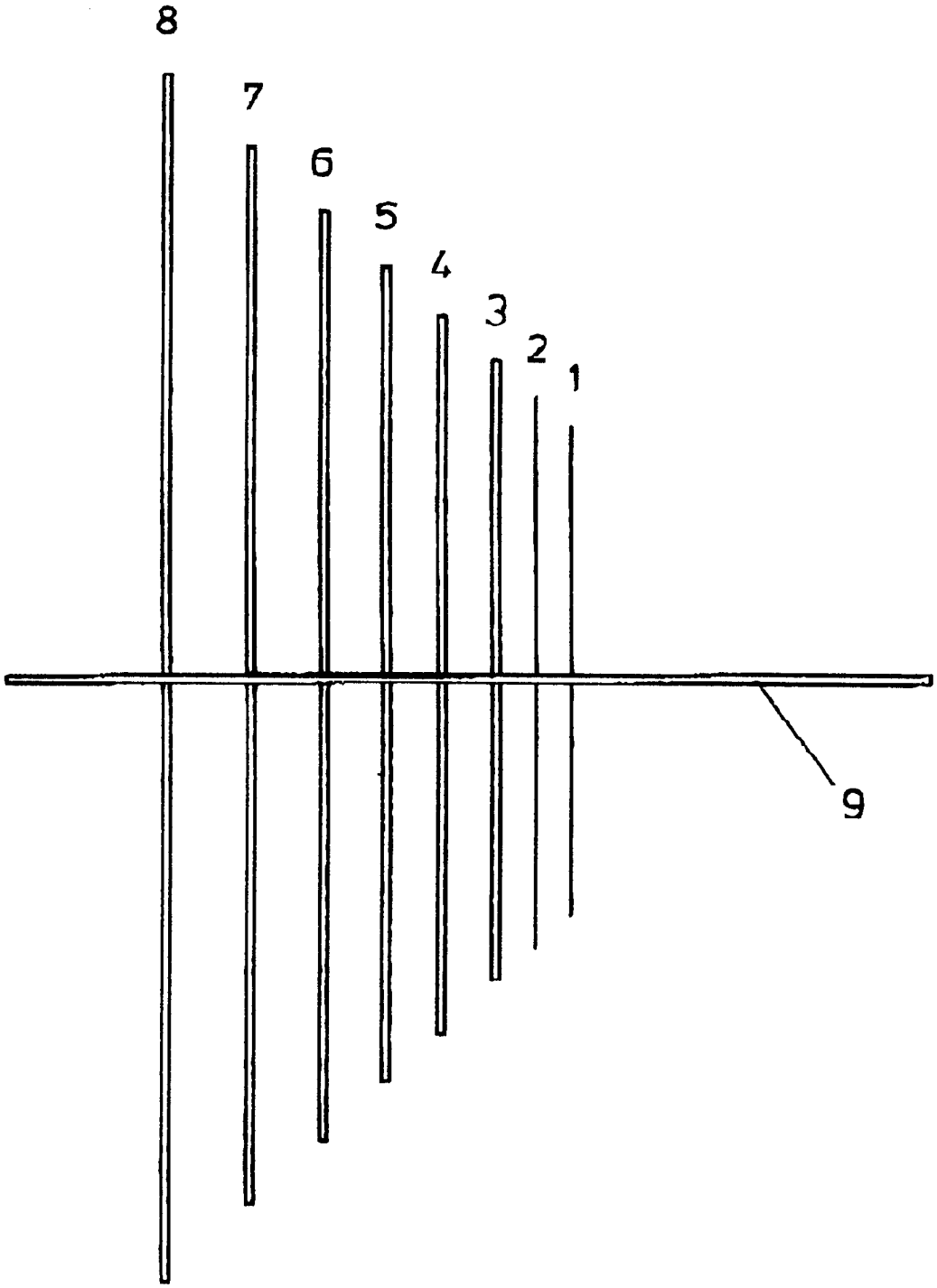
FIG. 1 is a schematic plan view of a preferred dipole element arrangement.

Referring to FIG. 1, a preferred log-periodic antenna is shown having, in this case, eight dipole elements 1–8 arranged in a plane normal to the plane of a central transmission line carried on PCB 9. Each dipole element 1–8 is independently fed by an independent feed line on the PCB 9. Each dipole element is selected to be of a length and thickness as will be familiar to the skilled person, from the longest, thickest element 8 intended to operate at a relatively low frequency, through to the shortest and thinnest element 1 intended to operate at a relatively high frequency For example, the longest element 8 is elected to have a half wavelength at 500 MHz, and the shortest element 1 at 1 GHz. Example dimensions, which may of course be scaled according to the intended use and power output of the antenna, are given in table 1.

The dipole elements are alternately fed, with the feed to alternate dipoles being reversed. The input signal is split, delayed and fed to each individual dipole by any suitable arrangement, which in the preferred embodiment is a PCB etched to leave feed lines on either side.

TABLE 1

| ELEMENT | LENGTH (MM) | DIAMETER (MM) |
|---|---|---|
| 8 | 150 | 2.6 |
| 7 | 132 | 1.8 |
| 6 | 116 | 1.6 |
| 5 | 108 | 1.6 |
| 4 | 90 | 1.2 |
| 3 | 79 | 1.2 |
| 2 | 69.5 | 0.8 |
| 1 | 61.5 | 0.8 |

Figure 2:
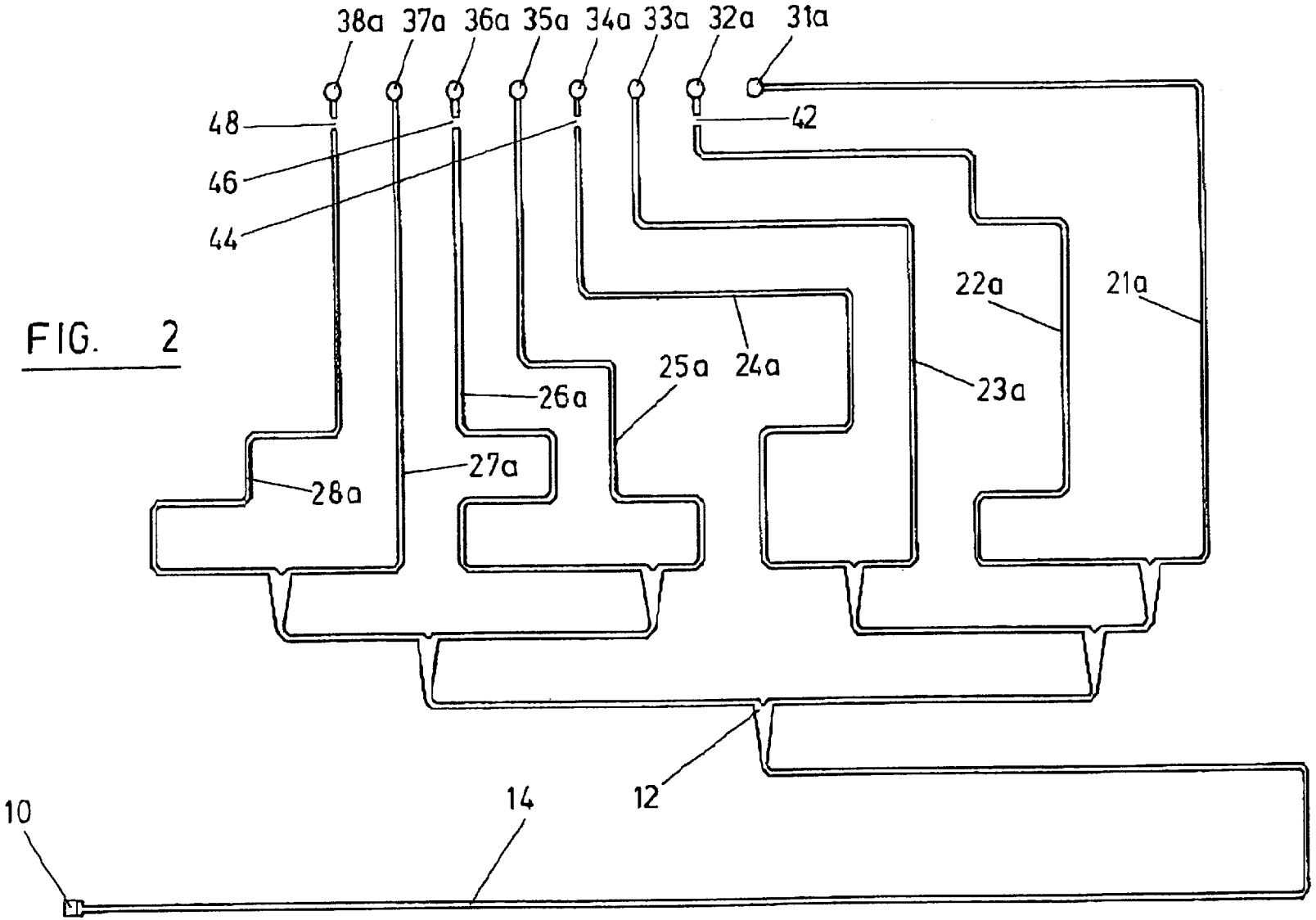
FIG. 2 is a schematic view of a top surface of a preferred PCB feed line arrangement.
Figure 3:
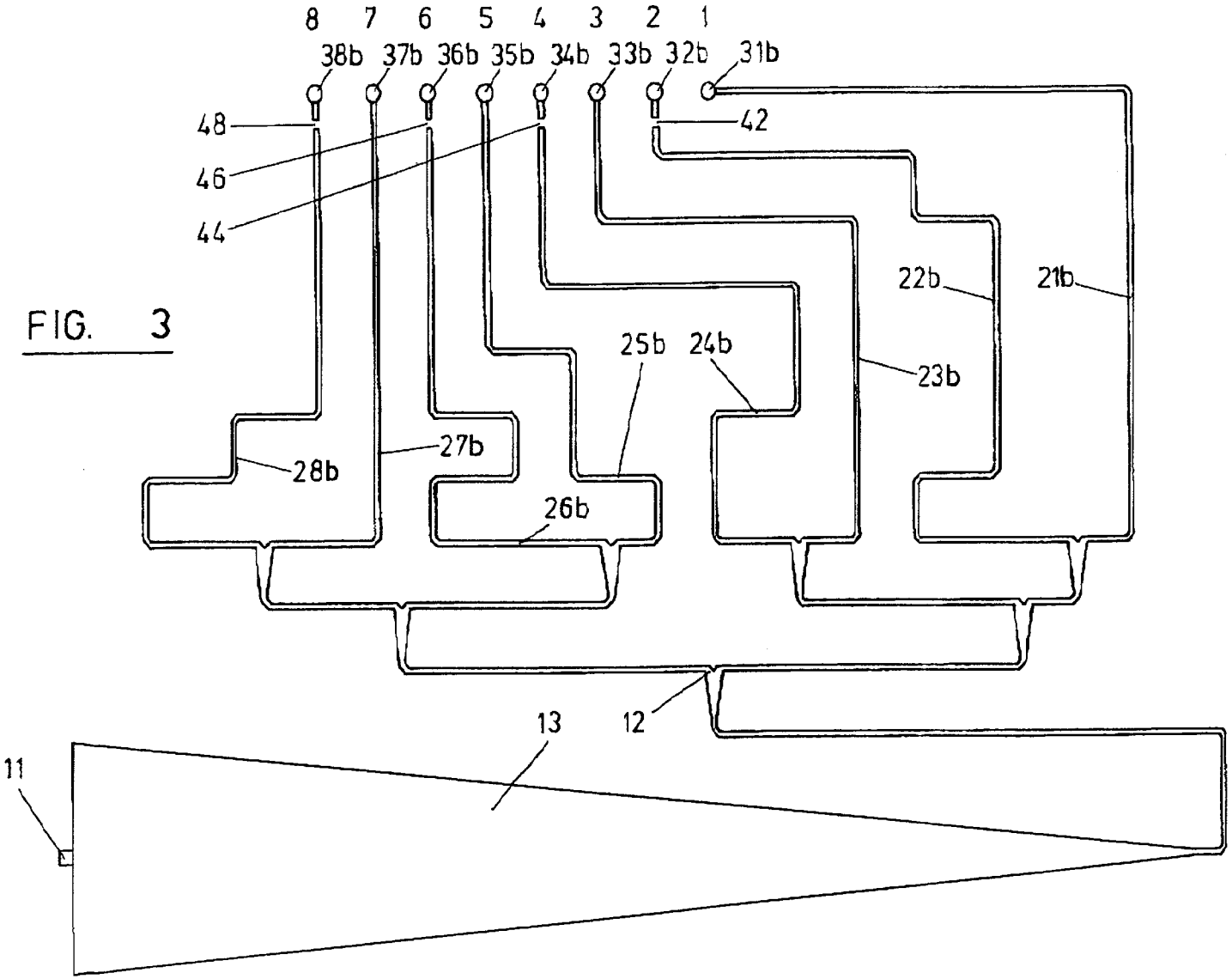
FIG. 3 is a schematic view of a bottom surface of the PCB arrangement of FIG. 2.

Referring to FIGS. 2 and 3, a preferred PCB layout is shown leading to pads 31*a*–38*a* corresponding to each of the dipole elements 1–8. FIG. 2 shows the top side of the PCB, with the reverse side being shown in FIG. 3. In FIGS. 2 and 3, an input signal, such as from a SMA connector at the end of a co-axial cable is connected, for example by soldering, to inputs 10 and 11, with the centre connector soldered to the top side input 10. The first portion of the transmission line 14 is common to all of the elements until it reaches a corporate point 12. From the corporate point 12, the transmission line is progressively split until separate transmission lines 21*a*–28*a* reach the pads 31*a*–38*a* for each dipole element 1–8.

The individual transmission lines 21*a*–28*a* may take any suitable form, with the preferred patterns shown being arranged for convenience in producing the PCB The patterns 21*a*–28*a* on the top side in FIG. 2 correspond to those of the bottom side 21*b*–28*b* shown in FIG. 3.

Referring now to FIG. 3, the input common section of the transmission line on the bottom side of the PCB comprises a tapered section 13 coupled via soldered connection 11 to the outer shell of a coaxial input line coupled, for example, through a SMA connector. The tapered section 13 acts as an unbalanced to balanced transformer. At the input end of the taper 13, the lower part of the transmission line is very wide and gives the impression of a ground plane By using a long, gentle taper, good broadband performance is achieved The widths of the transmission line tracks should be such as to maintain a defined characteristic impedance A convenient value of the characteristic impedance is 50 ohms since this is slightly lower than the basic dipole value of 73 ohms, and the combination of dipoles into an array reduces the impedance.

The bifurcations in the transmission lines cause a doubling of the characteristic impedance and this is transformed back to 50 ohms by the incorporation of tapered transitional sections, as seen in FIGS. 2 and 3.

Next, the determination of the length of each individual delay line 21–28 will be described in more detail.

As a first approximation, it might be assumed that the length of each delay line should be consistent with a traditional value of the logarithmic progression factor for the dimensions of the dipole elements, but reversed in sequence so that with the lengths of each feed line would be progressively reduced with increasing distance from the nose of the antenna, such that the total time delay from the corporate feed point 12 to each pad 31–38 plus the time delay in the radiated wave from the dipole at each pad to the nose of the antenna is equalised. Experimentally, such an arrangement was found to produce acceptable, but not good, results.

By comparison, a preferred arrangement has been established by experimentation. The preferred antenna has been selected to enable non-dispersive radiation of a band-limited pulse from a 2 ns gaussian input having a rise-time of the order of 400 ps, from an avalanche-breakdown pulse generator. To probe the radiated fields, two bow-tie dipole antennas were created with tapered resistive loading such that they were completely non-resonant. Tests of these bow-tie antennas showed that they had a good dead-beat response with rise times much less than one nanosecond.

An antenna with a relatively small spacing between the elements gives an excellent radiated, non dispersive, pulse. For an antenna constructed in accordance with the dimensions of table 1 above, the preferred delay line lengths for transmission lines 21–28 are given in table 2.

Referring now to FIG. 4, the feed to elements 2,4,6 and 8 is reversed by means of via holes in the PCB enabling the cross connection of the transmission lines. The via holes are shown schematically as gaps 42, 44, 46 and 48 in FIGS. 2 and 3.

TABLE 2

| ELEMENT | DELAY LINE (MM) | TIME DELAY (NS) | FEED DIRECTION |
|---|---|---|---|
| 8 | 381 | 0.6391 | FORWARD |
| 7 | 401 | 0.2357 | REVERSED |
| 6 | 345 | 0.8092 | FORWARD |
| 5 | 368 | 0.4798 | REVERSED |
| 4 | 315 | 0.9238 | FORWARD |
| 3 | 368 | 0.6656 | REVERSED |
| 2 | 277 | 1.0178 | FORWARD |
| 1 | 341 | 0.8889 | REVERSED |

The spacing between each dipole element 1–8 has been experimentally determined and the preferred spacings are shown in table 3 below.

TABLE 3

| DIPOLE PAIR | 8-7 | 7-6 | 6-5 | 5-4 | 4-3 | 3-2 | 2-1 |
|---|---|---|---|---|---|---|---|
| PAD SPACING (MM) | 18 | 15.8 | 14 | 12.2 | 10.8 | 9.4 | 8.4 |

The skilled person will appreciate that the spacing of the elements is far closer than is normally considered to be the optimum for log-periodic antennas, and that the time (and hence phase) delays in the feed lines 21–28 vary in a way that is contrary to intuition. Nonetheless, the preferred antenna has a good performance, particularly in respect of radiating pulse signals with minimal dispersion of the relative phases of frequency components across its operating bandwidth.

The antenna described herein has a number of advantages over prior art non-dispersive antennae, due to its efficiency, resulting from avoidance of a need for resistive components, and its directive properties, enabling it to beam its radiation predominantly within a limited range of angles. The relative dimensions of the antenna may be scaled according to the use intended, and dimensions may be changed by amounts of the order ±20%, or even ±50%, whilst still obtaining a satisfactorily operating antenna.

The antenna is efficient and directional with much weaker and dispersed waveforms being demonstrated in directions away from the main beam. The one-piece planar power divider for the array feed lines and the candidate designs for a very wideband printed log-periodic antenna allow a simple and inexpensive construction.

The antenna may be incorporated in a full array of pulsed antennas, such as an array of seven antennas with six arranged points of a hexagon and the seventh arranged substantially centrally. Other array geometries will be familiar to the skilled person.

The antenna described is capable or radiating pulsed and wideband signals without phase dispersion of the frequency components within the signal. The antenna is capable of radiating without resistive losses, i.e. with an efficiency close to 100%. Further, the antenna is capable of radiating with a directivity substantially greater than the basic dipole value of between 1.5 and 1.7, and advantageously is substantially smaller in weight and volume than a horn antenna. Further still, the antenna has the facility for independent tuning of the relevant phases of the frequency components.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A broadband antenna, comprising:

input means for receiving an input signal;

a plurality of antenna elements arranged to form a log-periodic antenna for radiating said input signal; and signal feed means for feeding said input signal from said input means to said plurality of antenna elements, the signal feed means comprising a plurality of feed lines each coupled to a respective antenna element of said plurality of antenna elements, each of said plurality of feed lines comprises a delay for delaying the input signal by a predetermined delay amount, such that said predetermined delay amount compensates for a phase delay between a position of the respective antenna element of said plurality of antenna elements and a predetermined phase reference point.

2. A broadband antenna as claimed in claim 1, wherein said predetermined delay amount is determined by the length of each respective feed line of said plurality of feed lines.

3. A broadband antenna as claimed in claim 1, wherein said predetermined reference point is at the front of the antenna.

4. A broadband antenna as claimed in claim 1, wherein said plurality of feed lines are provided by a circuit board.

5. A broadband antenna as claimed in claim 4, wherein said plurality of antenna elements are arranged generally parallel and co-planar, and said circuit board is arranged normal to said antenna elements.

6. A broadband antenna as claimed in claim 4, wherein said signal feed means comprises a feed network provided on said circuit board for splitting, delaying and feeding at least a respective portion of the input signal to each respective antenna element.

7. A broadband antenna as claimed in claim 6, wherein said feed network comprises a common transmission line coupled to receive said input signal and coupled to each of said plurality of feed lines.

8. A broadband antenna as claimed in claim 7, wherein said common transmission line is tapered to act as an unbalanced to balanced transformer.

9. A broadband antenna as claimed in claim 6, wherein said feed lines are arranged to reverse the phase of each alternate antenna element of said plurality of antenna elements.

10. A broadband antenna, comprising:

a plurality of antenna elements arranged to provide a log-periodic array of dipole elements for radiating an input signal; and a signal feed means comprising a plurality of feed lines each coupled to a respective antenna element of said plurality of antenna elements, each feed line being of a predetermined length such that all frequency components of the radiated signal across a predetermined operating range are in phase at a predetermined phase reference point.

* * * * *